United States Patent [19]

Boksberger et al.

[11] Patent Number: 4,811,032

[45] Date of Patent: Mar. 7, 1989

[54] METHOD FOR MONITORING AND CONTROLLING AN ANTENNA SELECTOR AND ANTENNA SELECTOR FOR CARRYING OUT THE METHOD

[75] Inventors: Hans U. Boksberger, Oberbözberg; Markus Jud, Gebenstorf; Anton Wettstein, Fislisbach, all of Switzerland

[73] Assignee: BBC Brown Boveri AG, Baden, Switzerland

[21] Appl. No.: 109,093

[22] Filed: Oct. 16, 1987

[30] Foreign Application Priority Data

Oct. 22, 1986 [CH] Switzerland ..... 4213/86

[51] Int. Cl.[4] ..... H01Q 3/24

[52] U.S. Cl. ..... 343/876; 343/850; 343/853; 342/374

[58] Field of Search ..... 343/876, 850, 853; 342/374

[56] References Cited

U.S. PATENT DOCUMENTS

| | | | |
|---|---|---|---|
| 2,127,336 | 8/1938 | Leng | 343/876 |
| 3,009,118 | 11/1961 | Stinson | 343/876 |
| 3,141,067 | 7/1964 | Spandorfer | 179/18 |
| 3,593,206 | 7/1971 | Schimann | 343/876 |
| 3,840,875 | 10/1974 | Neal | 343/876 |
| 3,935,394 | 1/1976 | Bulfer | 179/18 ES |
| 4,070,637 | 1/1978 | Assal et al. | 343/876 |

OTHER PUBLICATIONS

Surovov, "Antenna Feeder Devices", Telecommunications & Radio Engineering, vol. 29/30, No. 10, Oct. 1975, pp. 35–40.

Forcina et al., "Fault Detection/Diagnostics . . . Subsystem", 6th International Conference on Digital Satellite Communications, 19–23 Sep. 1983, pp. X-1–X-8.

Bird et al., "Testing Electrochromic Matric Displays", IBM Technical Disclosure Bulletin, vol. 25, No. 11A, Apr. 1983, pp. 5488–5489.

Ronen et al., "Monitoring Techniques for Phased-Array Antennas", IEEE Transactions on Antennas and Propagation, vol. AP-33, No. 12, Dec. 1985, pp. 1313–1327.

*Primary Examiner*—William L. Sikes
*Assistant Examiner*—Hoanganh Le
*Attorney, Agent, or Firm*—Oblon, Fisher, Spivak, McClelland & Maier

[57] ABSTRACT

In a method for monitoring and controlling an antenna selector in which a large number of switching points (U11, . . . Umn) are provided in matrix arrangement in order to connect m transmitters (S1, . . . , Sm) to n antennas (A1, . . . , An) in arbitrary manner, the switching state of the individual switching points is monitored and controlled by the switching points (U11, . . . , Umn) being sequentially selected by selection of the associated rows and columns.

Compared with the prior art in which separate signal lines were provided for each breaker at each switching point, this results in a distinct simplification in the wiring of the system.

10 Claims, 3 Drawing Sheets

METHOD FOR MONITORING AND CONTROLLING AN ANTENNA SELECTOR AND ANTENNA SELECTOR FOR CARRYING OUT THE METHOD

BACKGROUND OF THE INVENTION

1. Field of the Invention

The invention relates to the field of high-power broadcasting transmitters.

In particular, it relates to a method for monitoring and controlling an antenna selector, where the antenna selector has the form of a radio-frequency distribution matrix;

the elements of this matrix are formed by switching points;

the rows of this matrix are associated with a corresponding number of transmitters; and the columns of this matrix are associated with corresponding number of antennas; and at the switching points circuit breakers are arranged in each case with the aid of which connections between the transmitters and the antennas can be optionally switched.

The invention also relates to an antenna selector for carrying out the method which exhibits the features enumerated above.

2. Discussion of Background

In a shortwave broadcast transmitting center, the signals of m different transmitters (typically: m=3 . . . 10) are to be switched in accordance with the requirements of the program schedule and the propagation conditions, which fluctuate with the time of the day and season, to the antenna systems which are suitable in each case, that is n different antennas being available (typically: n=5 . . . 100).

Basically, it must be possible to connect each of the m transmitters to each of the n antennas. The group of change-over switches needed for this forms an (m×n) matrix having m rows and n columns which is known as antenna selector matrix, for example from the printed document Brown Boveri Information 5/6 (1983), pages 244–247.

The elements of this matrix are formed by switching points which, as a rule, contain two radio frequency rated circuit breakers by means of which, depending on breaker position, the row and column lines from transmitter to antenna, intersecting at the point, are diagonally connected or are switched through in a straight line, each line by itself. Circuit breakers suitable for this purpose (with appropriate microswitches for monitoring) are known, for example, from German Offenlegungsschrift No. 1776 367.

Since the antennas generally only cover a part of the shortwave range, switching operations outside the specified frequency range are not permissible. Therefore, a suitable antenna selector control system must not only sense the positions of the individual circuit breakers and compare them with the predetermined nominal arrangement, but also release or block the selected link between the transmitters and antennas on the basis of a table of permitted frequencies and of the frequency report by the transmitter concerned.

This test must take place continuously even during the operation of the transmitting center since it is possible to change the frequency of a transmitter without changing antenna. In addition, the circuit breakers are in most cases equipped for manual actuation for emergency operation. Due to these facts, a control system must therefore continuously sense and check the breaker position (positions) of the circuit breakers.

For monitoring purposes, the circuit breakers of the radio frequency distribution or antenna selector matrix are then simulated by leading or trailing microswitches which represent a monitoring matrix corresponding to the radio frequency distribution matrix.

In order to monitor the switched connections between the m transmitters and the n antennas, the switch positions of the microswitches in the monitoring matrix have previously been individually sensed in the prior art. With two possible positions per switch and two switches per switching point and with a matrix having m rows and n columns these are (4×m×n) separate signals for the entire matrix which have to be transmitted in each case via separate signal lines from the site of the radio frequency distribution matrix to the command or control center.

It can be immediately seen that, with the large number of signal lines, this cabling requires a correspondingly great expenditure especially since it is necessary to filter interfering radio frequency from the sensed signals when they enter into the control system.

In the same manner, a large effort is involved when the breaker motors for the circuit breakers are also driven individually and directly, that is to say via (m×n) control lines (analogously to the sensing of the breaker position).

SUMMARY OF THE INVENTION

The invention is based on the subject of specifying a method for monitoring and controlling an antenna selector and an antenna selector for carrying out the method by means of which the circuit expenditure can be drastically reduced.

In a method of the type initially mentioned, the object is achieved by the fact that, for the purpose of monitoring and controlling the switching state of the matrix, the switching points are sequentially selected by selecting the associated rows and columns.

The antenna selector of the type initially mentioned is distinguished by the fact that means for sequentially selecting the switching points via the rows and columns are provided in it.

According to a first preferred typical example of the method according to the invention, the switched connections in a monitoring matrix which corresponds to the radio frequency distribution matrix and the switching points of which contain microswitches which are associated with the circuit breakers and in each case simulate their breaker position are sensed by the monitoring matrix being cyclically selected row by row via corresponding row lines and being interrogated column by column via corresponding column lines, or being cyclically selected column by column via the column lines and interrogated row by row via the row lines.

According to a second preferred typical embodiment, the circuit breakers are operated by corresponding breaker motors with associated motor contactors, the contactors are combined in columns and rows within a matrix in such a manner that all motor contactors of one row have a common signal return line and all motor contactors of one column are attached to a common feedline via one diode each, and the corresponding motor contactors are sequentially selected by selecting the associated rows and columns for switching connections between the transmitters and the antennas.

Other typical embodiments are found in the subclaims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
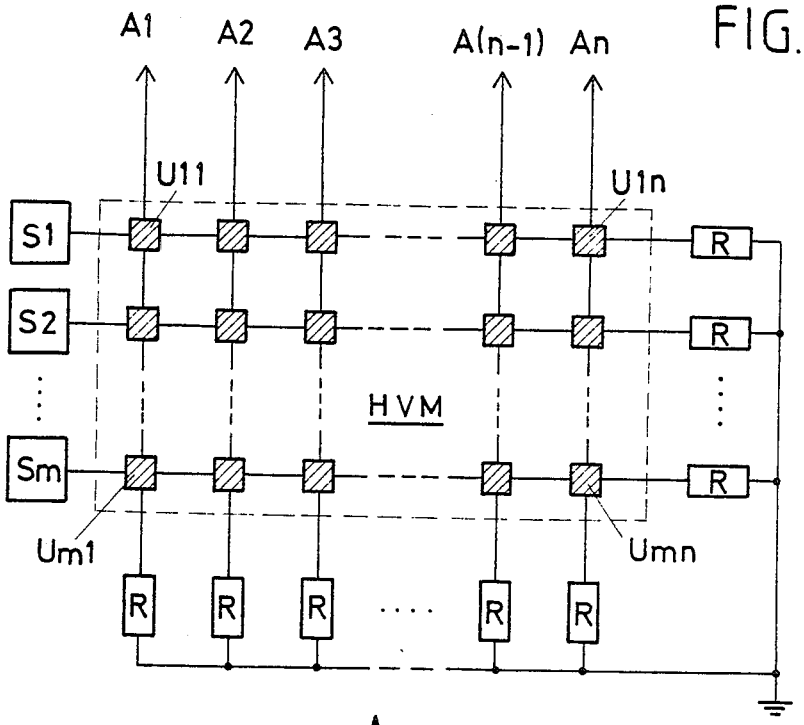
FIG. 1 shows the basic circuit diagram of a transmitting center having a plurality of transmitters and antennas and an interposed radio frequency distributor matrix (antenna selector matrix)

Referring now to the drawings, wherein like reference numerals designate identical or corresponding parts throughout the several views, FIG. 1 shows the basic circuit diagram of a transmitting center. The transmitting center comprises a plurality of m transmitters S1, . . . , Sm and a plurality of n antennas A1, . . . , An. The transmitters S1, . . . , Sm are allocated to the rows and the antennas A1, . . . , An to the columns of a radio frequency distribution matrix HVM which has the task of enabling any connection to be made between one of the transmitters S1, . . . , Sm and one of the antennas A1, . . . , An.

For this purpose, the radio frequency distribution matrix HVM exhibits a total of (m×n) switching points U11, . . . , Umn which are arranged at the points of intersection (junctions) of the row and column lines and are capable of connecting the respective row and column lines either diagonally or switch the lines through in a straight line, in each case by themselves.

Figure 2:
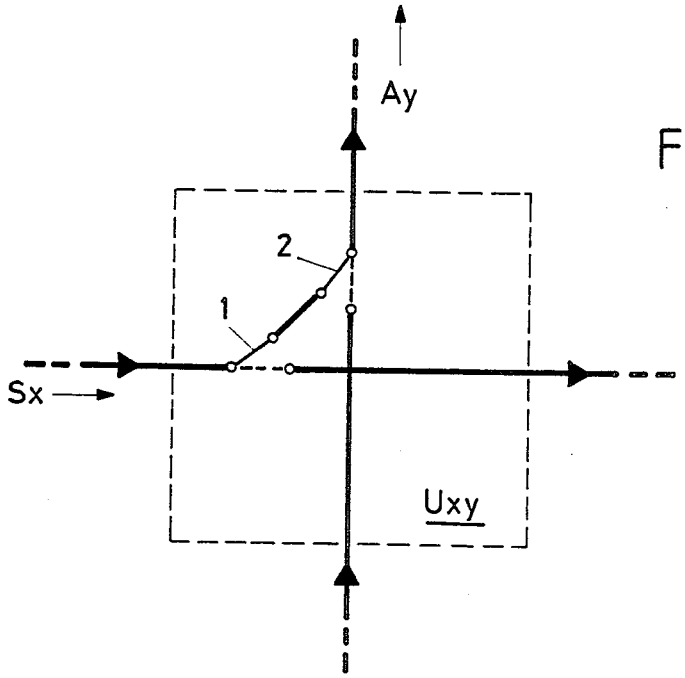
FIG. 2 shows the internal configuration of an individual switching point from the matrix according to FIG. 1.

An arbitrary switching point Uxy has the basic internal configuration shown in FIG. 2. In each case, a circuit breaker 1 and 2, which is constructed as a changeover switch in the examples given, is inserted into the horizontal row line and the vertical column line.

If the two circuit breakers 1 and 2 are in breaker position shown in FIG. 2, the straight-line continuation of the row and column line is interrupted. The two lines are simultaneously diagonally connected so that the signals from the transmitter Sx connected to the row line pass to the antenna Ay connected to the column line.

If, in contrast, the circuit breakers 1 and 2 are in their other breaker position drawn dashed in FIG. 2, the row line and the column line are switched through in a straight line to the next junction in each case.

The basic circuit diagram reproduced in FIG. 1 also shows that the row lines are terminated at the end opposite to the transmitters S1, . . . , Sm and the column lines are terminated at the end opposite to the antennas A1, . . . , An by terminating resistors R which lead to a common ground.

The terminating resistors R associated with the column and row lines have the task of bypassing the voltages induced in the antennas and lines of the matrix not used, that is to say not connected to a transmitter, to ground.

As has already been mentioned initially, the actual switching state, that is to say the breaker positions of the circuit breakers 1, 2 at the switching points U11, . . . , Umn must be continuously monitored in order to prevent malfunctions and disturbances in the transmitting operation. It is known to allocate to the circuit breakers 1, 2 corresponding microswitches which are switched over, either leading or trailing, together with the circuit breakers associated with them and thus, for monitoring purposes, simulate the circuit breakers in the small-signal range.

According to a preferred typical embodiment of the invention, these microswitches are arranged in the same manner as the circuit breakers themselves, in a monitoring matrix UM (FIG. 3) which is similar to the radio frequency distribution matrix HVM and also exhibits switching points $\overline{U}$11, . . . , $\overline{U}$mn in m rows and n columns (mxn). Each of the switching points $\overline{U}$11, . . . , $\overline{U}$mn has the same internal configuration as the switching point Uxy, shown in FIG. 2, of the radio frequency distribution matrix HVM, with the difference that the associated microswitches are now located at the position of the circuit breakers 1, 2 in that matrix.

Correspondingly, m row lines Z1, . . . , Zm and n column Lines C1, . . . , Cn are associated with the m rows and n columns of the monitoring matrix UM. Differing from the prior art in which the switch positions of the microswitches were interrogated via separate signal lines for each switch, the switching points $\overline{U}$11, . . . , $\overline{U}$mn are sequentially selected by the selection of the associated rows and columns and interrogated with respect to their switching state in the montoring matrix UM explained here. In this manner, it can be directly determined whether a particular transmitter is connected to a particular antenna or not.

Figure 3:
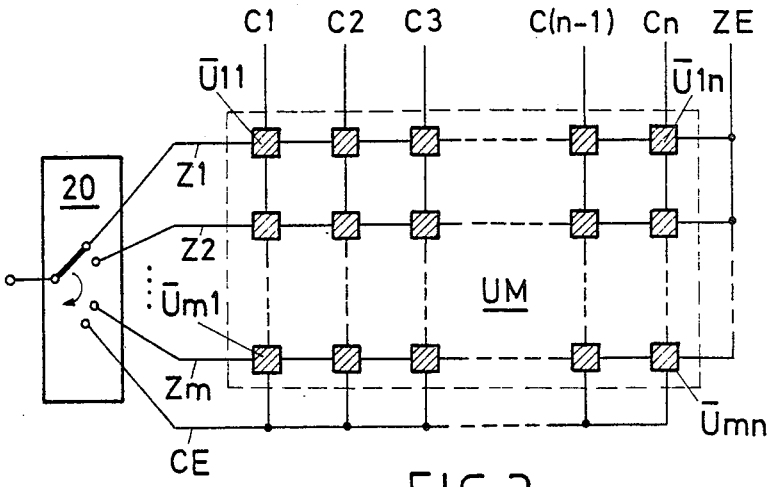
FIG. 3 shows a typical embodiment of a monitoring matrix belonging to the matrix according to FIG. 1.

The principle of sequential row selection is indicated in FIG. 3 by the row selector 20, drawn there, which successively switches a selection signal to the row lines Z1, . . . , Zm. The entire sequence control for the monitoring can be implemented, for example within the framework of an electronic stored-program control system.

Thus, the microswitches are connected to one another in the monitoring matrix UM in such a manner that they faithfully simulate the path of the radio frequency signal in the radio frequency distribution matrix HVM. However, the row lines Z1, . . . , Zm and the column lines C1, . . . , Cn alone cannot cover the switching states of the radio frequency distribution matrix HVM or of the monitoring matrix UM in which a row or a column is completely switched through in a straight line, that is to say in which a transmitter S1, . . . , Sm or an antenna A1, . . . , An is grounded via one of the terminating resistors R. However, it is especially this information which is of importance to know whether, when a connection between transmitter and antenna is cancelled, the breakers at the respective switching point have been correctly reset.

In order to be able to cover these cases, too, a column end line CE is provided as additional row line and a row end line ZE is provided as additional column line and these are linked to the monitoring matrix UM in the manner shown in FIG. 3, the terminating resistors R from FIG. 1 being simulated by simple conductive connections. The column end line CE is included in the sequential (cyclic) row seleciton system whereas the row end line ZE is included in the series of other column lines C1, . . . , Cn.

In summary, the operation of the circuit according to FIG. 3 can be described as follows: while the (n+1) column lines C1, . . . , Cn and ZE are being interrogated, the (m+1) row lines Z1, . . . , Zm and CE cyclically alternately receive the signal voltage (for example +24 V) used in the system. The cyclic feeding to the row lines (time multiplex operation) has the effect that the allocation of the transmitters to the antennas can be unambiguously sensed. Interrogation via the row end line ZE, in particular, allows the determination that a particular transmitter is "connected" to the external row end, that is to say whether the switching point switched diagonally has been correctly reset during an antenna change. The column end line CE allows the antennas to be determined which are grounded via the terminating resistors R. As can be easily seen, there is no significant change in the principle described if, instead of the row lines Z1, . . . , Zm and CE, the column lines C1, . . . , Cn and ZE are cyclically alternately supplied with the signal voltage and, correspondingly, the row lines Z1, . . . , Zm and CE are interrogated instead of the column lines C1, . . . , Cn and ZE.

In the control system according to the invention, there are now only (m+1+n+1) signal lines compared with the (4×m×n) signal lines in an antenna selector control system of the conventional type (4 signal lines per 2 breakers with 2 breaker positions each per junction), which leads to considerable savings with respect to the wiring expenditure especially in the case of matrices having a high number of rows and columns.

The principle described and put into effect in the invention makes it possible to obtain the information relevant to the operation of the transmitting center at a sampling rate given by the number of transmitters and the processing speed of the stored-program control system used (generally about 100 Hz). Although the positions of not all breakers in operation are being sensed in this arrangement, the required reliability is fully guaranteed since at least all absolutely necessary position signals are supplied at an adequate sampling rate.

It should also be pointed out at this point that the control system described fully supports an automatic self testing of the radio frequency distribution matrix which is useful, for example, as an aid for commissioning and after relatively large inspections. In particular, the correct wiring of the selection and signalling line and the operation of the breaker motors operating the circuit breakers can be automatically checked by means of the available information.

With respect to the selection of such breaker motors, of which at least one and in most cases two exist per switching point, the principle of matrix selection according to the invention can also be used for reducing the wiring expenditure even in this case. In this manner, the originally (m×n) control lines can be replaced by (m+n) lines.

Figure 4:
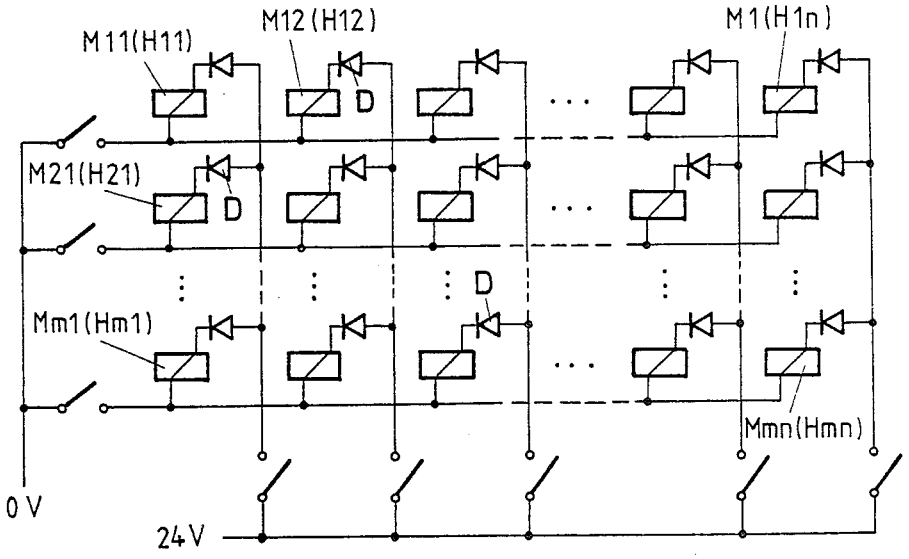
FIG. 4 shows the matrix arrangement of motor contactors of the breaker motors for a matrix according to FIG. 1 with a simplified selection system.

According to a preferred typical embodiment, referred to by the representation of FIG. 4, the motor contactors M11, . . . , Mmn necessary for the breaker motors, or their holding relays H11, . . . , Hmn are combined within a matrix by columns and rows in the wiring in such a manner that all motor contactors of one row have a common signal return line (connected via corresponding switches and 0-V potential in FIG. 4) and all motor contactors of one column are attached to a common feedline by one diode D each (connected to 24-V potential via corresponding switches in FIG. 4).

For switching arbitrary connections between the transmitters S1, . . . , Sm and the antennas A1, . . . , An, the corresponding motor contactors are sequentially selected by selecting the associated rows and columns (by closing the associated switches) in the configuration of FIG. 4.

The type of selection described up till now necessitates that the individual switching processes at the switching points are sequentially executed. In a broadcast transmitting center, however, the antenna changes usually occur lumped at particular times (for example each full hour) so that noticeable delays would occur due to the sequential execution.

According to a further development of the control system according to the invention, this time restriction in the switching processes can be circumvented. The prerequisite for this is the use of breaker motors which are equipped with a limit trip. Under this condition, each of the motor contractors M11, . . . , Mn can then be equipped with a self-holding device which holds a run or switch command, once given, for a long as another command relating to the direction of movement is present.

Figure 5:
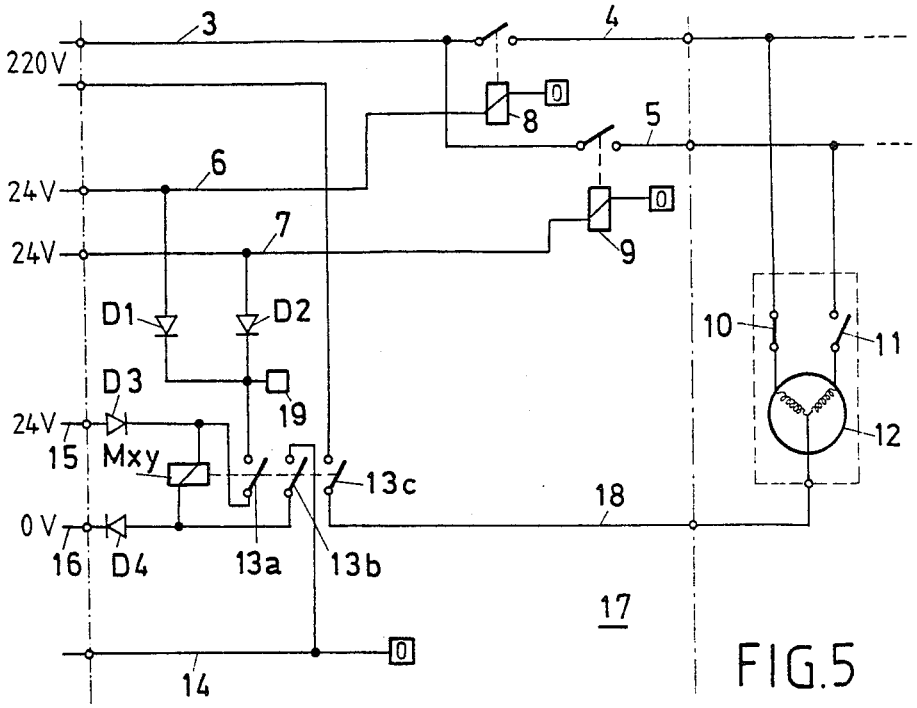
FIG. 5 shows a section of the circuit diagram for a breaker motor of the matrix according to FIG. 1 such as is needed for reducing the antenna selection times according to an advantageous typical embodiment.
Figure 6:
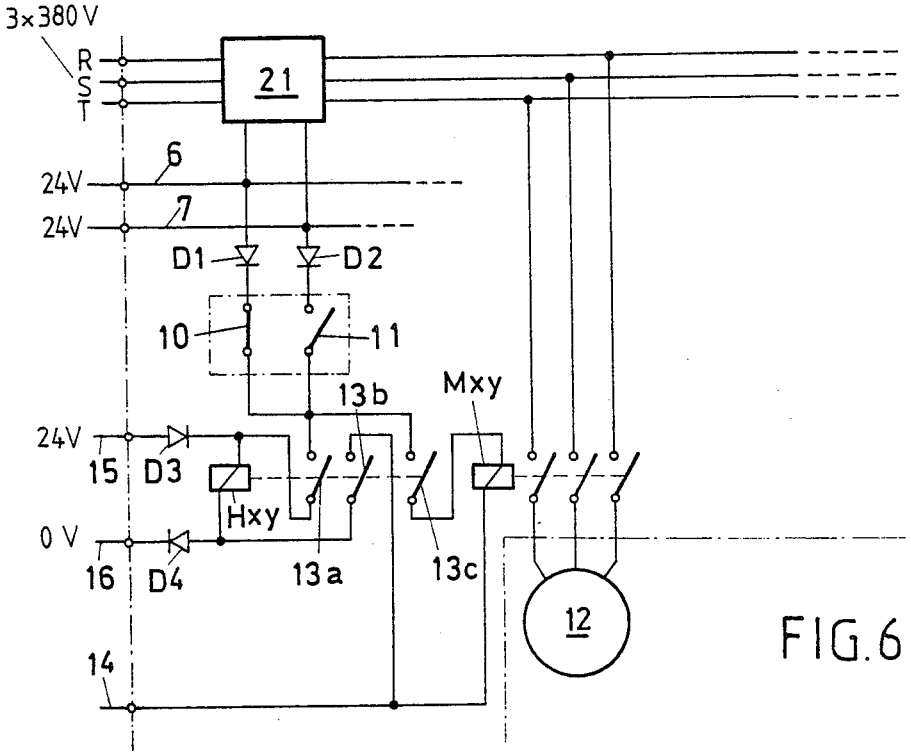
FIG. 6 shows a variant of FIG. 5 for 380-V three-phase motors.

FIG. 5 shows a section of a corresponding circuit which applies to a selected breaker motor 12 from the matrix. The braker motor 12 is, for example, a 220-V single-phase motor with two different windings for the two different directions of rotation. Each direction of rotation is associated with a corresponding limit trip 10, 11 which interrupts the current supply to the motor on one side when the limit position connected with the swiching-over of the circuit breakers 1, 2 has been reached. FIG. 6 shows a section of a corresponding circuit variant with 380-V three-phase motors, the same elements being provided with the same reference symbols.

The two directions of rotation of the breaker motor 12 will be subsequently desginated as through direction and diagonal direction, the through direction being given, referring to FIG. 2, when the circuit breakers 1, 2 are switched from the position given there into the dashed position, that is to say when the row and column are "switched through" in a straight line.

The through direction in FIG. 5 is associated with the limit trip 10 and the through supply 4. The diagonal direction is associated with limit trip 11 and the diagonal supply 5. Both supplies are branched off a common 220-V supply line 3 and are in each case cut in via a through relay 8 or diagonal relay 9 which are operated with 24-V signals via the lines 6 and 7, respectively, for direction command "through" or "diagonal".

In FIG. 6, instead, the supply for the breaker motor 12 is switched through via a phase exchanger 21 with a different sequence of the R, S, T phases, depending on the direction, "through" (6) or "diagonal" (7), respectively.

It can be immediately seen that it is exactly the direction of motion of the breaker motor 12 which is determined via the lines 6 and 7, respectively. However, since the supplies 4 and 5 are not only responsible for the selected breaker motor 12 but jointly for all breaker motor of the matrix, it is in each case the direction of motion of all breaker motors which is simultaneously determined by the direction commands on 6 and 7, respectively.

The other supply line 18 of the breaker motor 12 is switched individually for each breaker motor by a motor contactor contact 13*c* of the associated motor contactor Mxy. Two further motor contactor contacts 13*a* and 13*b* are part of the self-holding device already mentioned, in which arrangement the motor contactor contact 13*a* connects the motor contactor winding via a holding voltage terminal 19, which is common to all contactors, and two diodes D1, D2 to the lines 6 and 7 for direction command "through" and "diagonal" while the other motor contactor contact 13*b* switches the connection of the motor contactor winding to a common ground line 14.

The motor contactor Mxy is at the same time connected via two further diodes D3, D4 to a column control system 15 (24 V) and a row control system 16 (0 V) as is shown in FIG. 4 for the entire matrix. The circuit sections arranged within the two vertical dot-dashed lines are accommodated in a control cabinet 17 from which the radio frequency distribution matrix HVM is controlled.

With the circuit arrangement according to FIG. 5 and FIG. 6, an antenna change takes place in two stages:

(a) In the first stage, all switching points of the radio frequency distribution matrix which are not to remain set (that is to say which are not to remain switched diagonally) are reset. For this purpose, the continuous command "motion direction through" is first set (24 V signal to 6; through relay 8 operated), this command is present until the end of the first stage.

Then, the motor contactors or holding relays of the switching points concerned are set (operated) by means of sequential pulses of sufficient length (about 100 ms, depending on relay pickup and dropout time) via the corresponding row and column control system 15, 16, there being one line 15 each per row and one line 16 each per column. These are held via the self-holding device described until the persistent command "motion direction through" (no voltage on line 6) is cancelled. The breaker motors of the motor contactors set run until they have reached their limit position in the through direction and then automatically switch off by means of the corresponding limit trips even if the motor contactor remains set.

After all motor contactors of all switching points concerned have been sequentially set, the "motion direction through" command remains present for the maximum period allowed to a breaker motor for reaching its limit position (with a suitable safety margin). The first stage ends with the cancellation of the motion direction command.

(b) In the second stage, all switching points are set which are to be newly set (that is to say are to be diagonally switched). After a brief interval following the first stage, the length of which is determined by the dropout time of the self-held motor contactors or holding relays, has lapsed, the persistent command "motion direction diagonal" (24-V signal on line 7; diagonal relay 9 operated) is set; this command is present until the end of the second stage.

As in the first stage, the motor contactors or holding relays of the switching points concerned are then selected and set and are held for as long as the command is present. The breaker motors now run in diagonal direction until they have reached their limit position and automatically switch off by means of the limit trips.

The advantage of this type of selection lies in the fact that only the relatively short selection pulses for the motor contactors actually need to be sequential whereas the time in which the individual breaker motors run can overlap. This results in considerable timesaving compared with a completely sequential switching of the individual switching points.

Overall, the method and device according to the invention makes it possible to implement a drastically simplified antenna selector control system.

What is claimed as new and desired to be secured by Letter Patent of the United States is:

1. Antenna switching exchange comprising:

a plurality of rf power lines arranged in a first (m×n)-dimensional matrix, which serves as an rf distribution matrix, with m first row lines and n first column lines, where m and n are integers greater than one;

each of said first row lines being connected to a transmitter and each of said first column lines being connected to an antenna;

said first row lines and said first column lines crossing at first switching points forming the elements of said first matrix;

at each of said first switching points a first arrangement of power switches, said first arrangement having first and second switching positions, wherein in the first of said switching positions the first row line and the first column line crossing at the respective first switching point are each through-connected, and wherein in the second of said switching positions said through-connections are interrupted and said crossing first row line and first column line are interconnected;

a plurality of signalling lines arranged in a second (m×n)-dimensional matrix, which serves as a monitoring matrix, with m second row lines and n second column lines, where m and n are integers greater than one;

said second row lines and said second column lines crossing at second switching points forming the elements of said second matrix;

at each of said second switching points a second arrangement of microswitches, said second arrangement similar to said first arrangement, the microswitches of said second arrangement having first and second switching positions, wherein the first of said switching positions the second row line and the second column line crossing at the respective second switching point are each through-connected, and wherein in the second of said switching positions said through-connections are interrupted and said crossing second row line and second column line are interconnected;

each of said microswitches being associated with and switched in conjunction with one of said power switches, thereby simulating the switching position of the associated power switches;

first means for sequentially applying a signal voltage to each of said second row lines; and second means for interrogating each of said second column lines during each step of said signal voltage application sequence.

2. Antenna switching exchange according to claim 1, wherein:

said first column lines are each grounded at an end opposite the said antenna via a terminating resistor;

said second column lines are each connected to a common column end line; and said first means sequentially applies said signal voltage to each of said second row lines and said column end line.

3. Antenna switching exchange according to claim 2, wherein:

said first row lines are each grounded at an end opposite to said transmitter via a terminating resistor;

said second row lines are each connected to a common row end line; and said second means interrogates each of said second column lines and said row end line during each step of said signal voltage application sequence.

4. Antenna switching exchange according to claim 3, wherein:

each of said power switches is operated by a switch motor having a motor contactor;

said motor contactors are arranged in m rows and n columns of a third (m×n)-dimensional matrix;

all motor contactors of one of said m rows are connected to one of m common signal return lines;

all motor contactors of one of said n columns are connected to one of n common feed lines via a diode each; and third means are provided to select one of said signal return lines and one of said feed lines.

5. Antenna switching exchange according to claim 4, wherein:

said switch motors are each equipped with limit trips for one limit position in each direction of rotation;

said motor contactors of said switch motors are in each case equipped with a self-holding device;

the direction of rotation of said switch motor can be jointly selected for all of said switch motors;

for each of said switch motors said limit trips and said motor contactor are connected to supply lines of said switch motor in such a manner that, in order to set up one of said switching positions, said motor contactor can be set by a selection pulse, is self-held and supplies said switch motor with current until it is switched off by one of said limit trips when reaching one of said limit positions.

6. Antenna switching exchange comprising:

a plurality of rf power lines arranged in a first (m×n)-dimensional matrix, which serves as an rf distribution matrix, with m first row lines and n first column lines, where m and n are integers greater than one;

each of said first row lines being connected to a transmitter and each of said first column lines being connected to an antenna;

said first row lines and said first column lines crossing at fields switching points forming the elements of said first matrix;

at each of said first switching points a first arrangement of power switches, said first arrangement having first and second switching positions, wherein in the first of said switching positions the first row line and the first column line crossing at the respective first switching point are each through-connected, and wherein in the second of said switching positions said through-connections are interrupted and said crossing first row line and first column line are interconnected;

a plurality of signalling lines arranged in a second (m×n)-dimensional matrix, which serves as a monitoring matrix, with m second row lines and n second column lines, where m and n are integers greater than one;

said second row lines and said second column lines crossing at second switching points forming the elements of said second matrix;

at each of said second switching points a second arrangement of microswitches, said second arrangement arranged similar to said first arrangement, the microswitches of said second arrangement having first and second switching positions, wherein in the first of said switching positions the second row line and the second column line crossing at the respective second switching point are each through-connected, and wherein in the second of said switching positions said through-connections are interrupted and said crossing second row line and second column line are interconnected;

each of said mircoswitches being associated with and switched in conjunction with one of said power switches, thereby simulating the switching position of the associated power switches;

first means for sequentially applying a signal voltage to each of said second column lines; and second means for interrogating each of said second row lines during each step of said signal voltage application sequence.

7. Antenna switching exchange according to claim 6, wherein:

said first row lines are each grounded at an end opposite to said transmitter via a terminating resistor;

said second row lines are each connected to a common row end line; and said first means sequentially applies said signal voltage to each of said second column lines and said row end line.

8. Antenna switching exchange according to claim 7, wherein:

said first column lines are each grounded at an end opposite to said antenna via a terminating resistor;

said second column lines are each connected to a common column end line; and said second means interrogates each of said second row lines and said column end line during each step of said signal voltage application sequence.

9. Antenna switching exchange according to claim 8, wherein:

each of said power switches is operated by a switch motor having a motor contactor;

said motor contactors are arranged in m rows and n columns of a third (m×n)-dimensional matrix;

all motors contactors of one of said m rows are connected to one of m common signal return lines;

all motor contactors of one of said n columns are connected to one of n common feed lines via a diode each; and third means are provided to select one of said signal return lines and one of said feed lines.

10. Antenna switching exchange according to claim 9, wherein:

said switch motors are each equipped with limit trips for one limit position in each direction of rotation;

said motor contactors of said switch motors are in each case equipped with a self-holding device;

the direction of rotation of said switch motors can be jointly selected for all of said switch motors;

for each of said switch motors said limit trips and said motor contactor are connected to supply lines of said switch motor in such a manner that, in order to set up one of said switching positions, said motor contactor can be set by a selection pulse, is self-held and supplies said switch motor with current until it is switched off by one of said limit trips when reaching one of said limit positions.

* * * * *